US007086367B2

(12) United States Patent
Procknow

(10) Patent No.: US 7,086,367 B2
(45) Date of Patent: Aug. 8, 2006

(54) AIR FLOW ARRANGEMENT FOR A REDUCED-EMISSION SINGLE CYLINDER ENGINE

(75) Inventor: Dave Procknow, Elm Grove, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 133 days.

(21) Appl. No.: 10/919,641

(22) Filed: Aug. 17, 2004

(65) Prior Publication Data

US 2006/0037577 A1 Feb. 23, 2006

(51) Int. Cl.
*F02F 1/42* (2006.01)

(52) U.S. Cl. ..... 123/193.5; 123/195 R; 123/188.6

(58) Field of Classification Search ..... 123/195 R, 123/193.5, 190.14, 188.9, 188.6, 188.8, 188.14
See application file for complete search history.

(56) References Cited

U.S. PATENT DOCUMENTS

| | | | | |
|---|---|---|---|---|
| 1,087,803 | A | | 2/1914 | Melling |
| 1,244,481 | A | | 10/1917 | Duesenberg et al. |
| 1,267,337 | A | | 5/1918 | Huebotter |
| 1,293,712 | A | | 2/1919 | Church |
| 1,311,060 | A | | 7/1919 | Felix |
| 1,315,788 | A | | 9/1919 | Murray |
| 1,351,950 | A | | 9/1920 | Gaston |
| 1,464,282 | A | | 8/1923 | Klossner |
| 1,507,666 | A | | 9/1924 | Davis |
| 1,521,440 | A | | 12/1924 | Foster |
| 1,656,065 | A | | 1/1928 | Heinemann |
| 3,650,250 | A | | 3/1972 | Lohr et al. |
| 3,757,749 | A | | 9/1973 | Hatz |
| 3,823,702 | A | * | 7/1974 | Roberts ..... 123/188.14 |
| 4,216,746 | A | | 8/1980 | Freyn |
| 4,396,407 | A | | 8/1983 | Reese |
| 4,603,663 | A | | 8/1986 | Giocastro |
| 4,662,328 | A | | 5/1987 | Kronich |
| 4,697,555 | A | | 10/1987 | Fujikawa et al. |
| 4,716,861 | A | | 1/1988 | Fujikawa et al. |
| 4,762,098 | A | | 8/1988 | Tamba et al. |
| 4,922,863 | A | | 5/1990 | Adams |
| 4,969,434 | A | | 11/1990 | Nakagawa |
| 5,000,126 | A | | 3/1991 | Isaka et al. |
| 5,058,542 | A | | 10/1991 | Grayson et al. |
| 5,176,116 | A | | 1/1993 | Imagawa et al. |
| 5,213,074 | A | | 5/1993 | Imagawa et al. |

(Continued)

FOREIGN PATENT DOCUMENTS

| | | |
|---|---|---|
| EP | 1 201 883 | 5/2002 |

(Continued)

OTHER PUBLICATIONS

FIG. A illustrates a side view of an engine housing of a vertical-shaft QUANTUM brand engine sold by Briggs and Stratton Corp. at least as early as Jul. 1989. (Statement of Relevance Attached).

(Continued)

*Primary Examiner*—Tony M. Argenbright
*Assistant Examiner*—Katrina Harris
(74) *Attorney, Agent, or Firm*—Michael Best & Friedrich LLP

(57) ABSTRACT

The present invention provides a reduced emission, single cylinder engine incorporating an air flow arrangement for improving flow efficiency of the intake air drawn into the engine and the exhaust discharged from the engine.

13 Claims, 9 Drawing Sheets

U.S. PATENT DOCUMENTS

| | | | |
|---|---|---|---|
| 5,233,967 | A | 8/1993 | Peller |
| 5,243,936 | A | 9/1993 | Kobayashi |
| 5,293,847 | A | 3/1994 | Hoffman et al. |
| 5,421,292 | A | 6/1995 | Hoffman et al. |
| 5,421,297 | A | 6/1995 | Tamba et al. |
| 5,564,374 | A | 10/1996 | Hoffman et al. |
| 5,588,408 | A | 12/1996 | Kurihara |
| 5,606,943 | A | 3/1997 | Tamba et al. |
| 5,606,944 | A | 3/1997 | Kurihara |
| 5,706,769 | A | 1/1998 | Shimizu |
| 5,755,194 | A | 5/1998 | Moorman et al. |
| 5,857,441 | A | 1/1999 | Yonezawa et al. |
| 5,884,593 | A | 3/1999 | Immel et al. |
| 5,937,816 | A | 8/1999 | Wincewicz et al. |
| 5,937,836 | A | 8/1999 | Yonezawa et al. |
| 5,947,070 | A | 9/1999 | Immel et al. |
| 5,979,392 | A | 11/1999 | Moorman et al. |
| 5,988,135 | A | 11/1999 | Moorman et al. |
| 6,032,635 | A | 3/2000 | Moorman et al. |
| 6,039,020 | A | 3/2000 | Kawamoto et al. |
| 6,202,616 | B1 | 3/2001 | Gracyalny |
| 6,223,713 | B1 | 5/2001 | Moorman et al. |
| 6,276,324 | B1 | 8/2001 | Adams et al. |
| 6,279,522 | B1 | 8/2001 | Balzar et al. |
| 6,349,688 | B1 | 2/2002 | Gracyalny et al. |
| 6,460,502 | B1 | 10/2002 | Gracyalny |
| 6,499,453 | B1 | 12/2002 | Immel et al. |
| 2002/0139339 | A1 | 10/2002 | Rado et al. |
| 2002/0185093 | A1 | 12/2002 | Immel et al. |

FOREIGN PATENT DOCUMENTS

| | | |
|---|---|---|
| EP | 1 247 950 | 10/2002 |
| GB | 122468 | 1/1919 |

OTHER PUBLICATIONS

FIG. B illustrates a top view of the engine housing of FIG. A (Statement of Relevance Attached).

FIG. C illustrates a cross-sectional view of the engine housing of FIG. A, depicting an intake port and an intake valve positioned in the intake port (Statement of Relevance Attached).

FIG. D illustrates a cross-sectional view of the engine housing of FIG. A, depicting an exhaust port and an exhaust valve positioned in the exhaust port (Statement of Relevance Attached).

FIG. E illustrates a perspective view of an intake pipe for use with the engine housing of FIG. A, (Statement of Relevance Attached).

FIG. F illustrates a cross-sectional view of the intake pipe of FIG. E (Statement of Relevance Attached).

* cited by examiner

AIR FLOW ARRANGEMENT FOR A REDUCED-EMISSION SINGLE CYLINDER ENGINE

FIELD OF THE INVENTION

This invention relates generally to engines, and more particularly to low-cost, single cylinder engines.

BACKGROUND OF THE INVENTION

Government regulations pertaining to exhaust emissions of small engines, such as those utilized in lawnmowers, lawn tractors, string trimmers, etc., have become increasingly strict. More particularly, such regulations govern the amount of hydrocarbons and nitrous oxides exhausted by the engine. Currently, several different engine technologies are available for decreasing hydrocarbon emissions, such as, for example, sophisticated fuel injection systems and exhaust catalyst devices. These or other more sophisticated technologies are difficult to incorporate into small engines and are expensive.

SUMMARY OF THE INVENTION

The present invention provides an air flow arrangement for a reduced-emission, single cylinder engine that improves air-fuel mixing in a carbureted engine, and enables the air-fuel mixture to be properly calibrated.

The air flow arrangement includes an engine housing, an intake opening positioned on a first side of the engine housing, an exhaust opening positioned on a second side of the engine housing adjacent the first side, and an inlet crossover passageway for introducing intake air to the engine. The inlet crossover passageway draws intake air from a location disposed from the second side. The air flow arrangement also includes an intake passageway defined in the engine housing downstream of the intake opening. The intake passageway has first and second cross-sectional areas defined by respective first and second planes passing substantially transversely through the intake passageway. The first cross-sectional area is larger than the second cross-sectional area and disposed further from the intake opening than the second cross-sectional area to increase flow efficiency of the intake air through the intake passageway. The air flow arrangement further includes an exhaust passageway defined in the engine housing upstream from the exhaust opening. The exhaust passageway has third and fourth cross-sectional areas defined by respective third and fourth planes passing substantially transversely through the exhaust passageway. The third cross-sectional area is larger than the fourth cross-sectional area and is disposed closer to the exhaust opening than the fourth cross-sectional area to increase flow efficiency of exhaust gases through the exhaust passageway.

Other features and aspects of the present invention will become apparent to those skilled in the art upon review of the following detailed description, claims and drawings.

BRIEF DESCRIPTION OF THE DRAWINGS

In the drawings, wherein like reference numerals indicate like parts.

Figure 1:
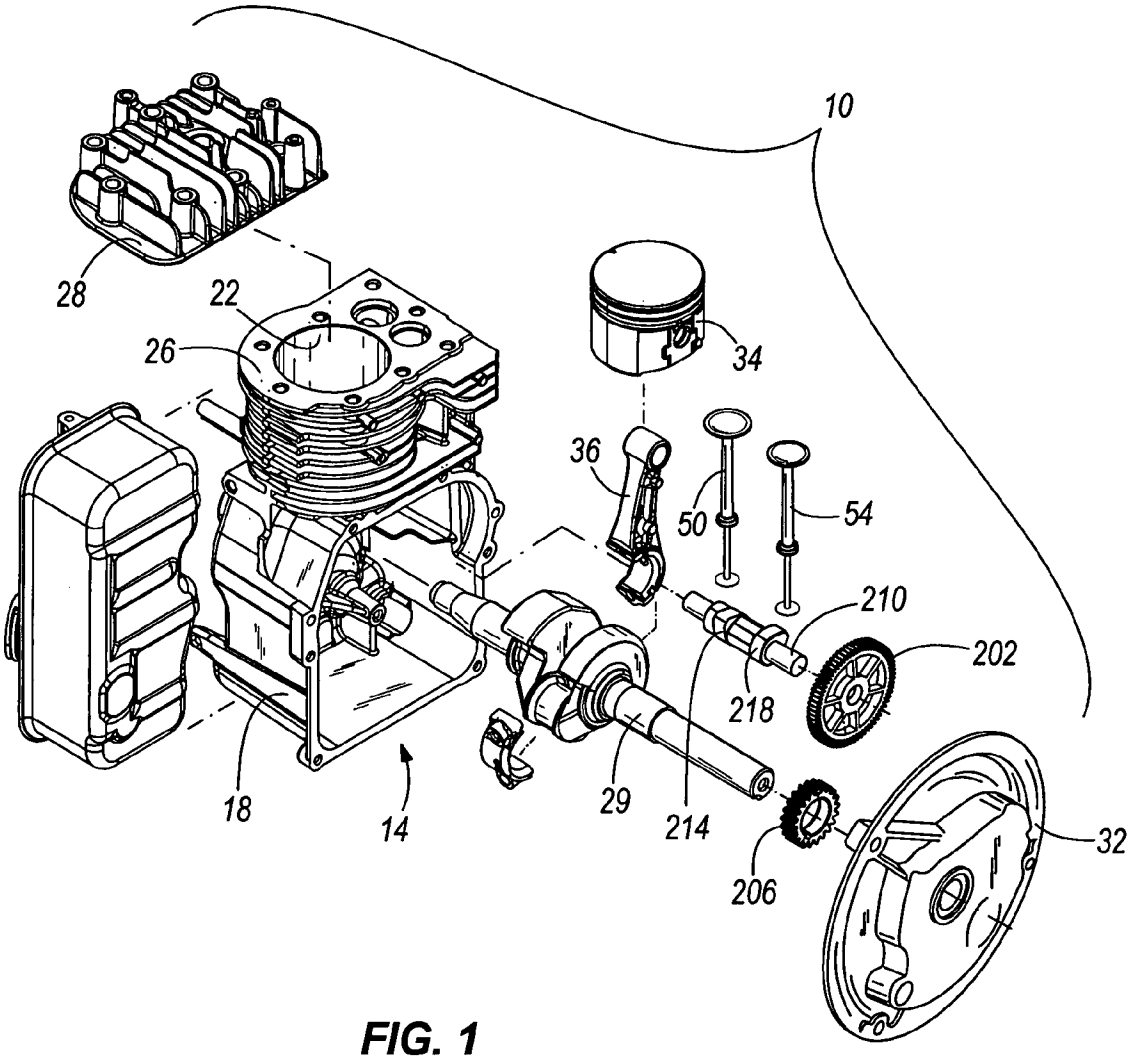
FIG. 1 is an exploded perspective view of a reduced-emission, single cylinder air-cooled engine of the present invention.
Figure 2:
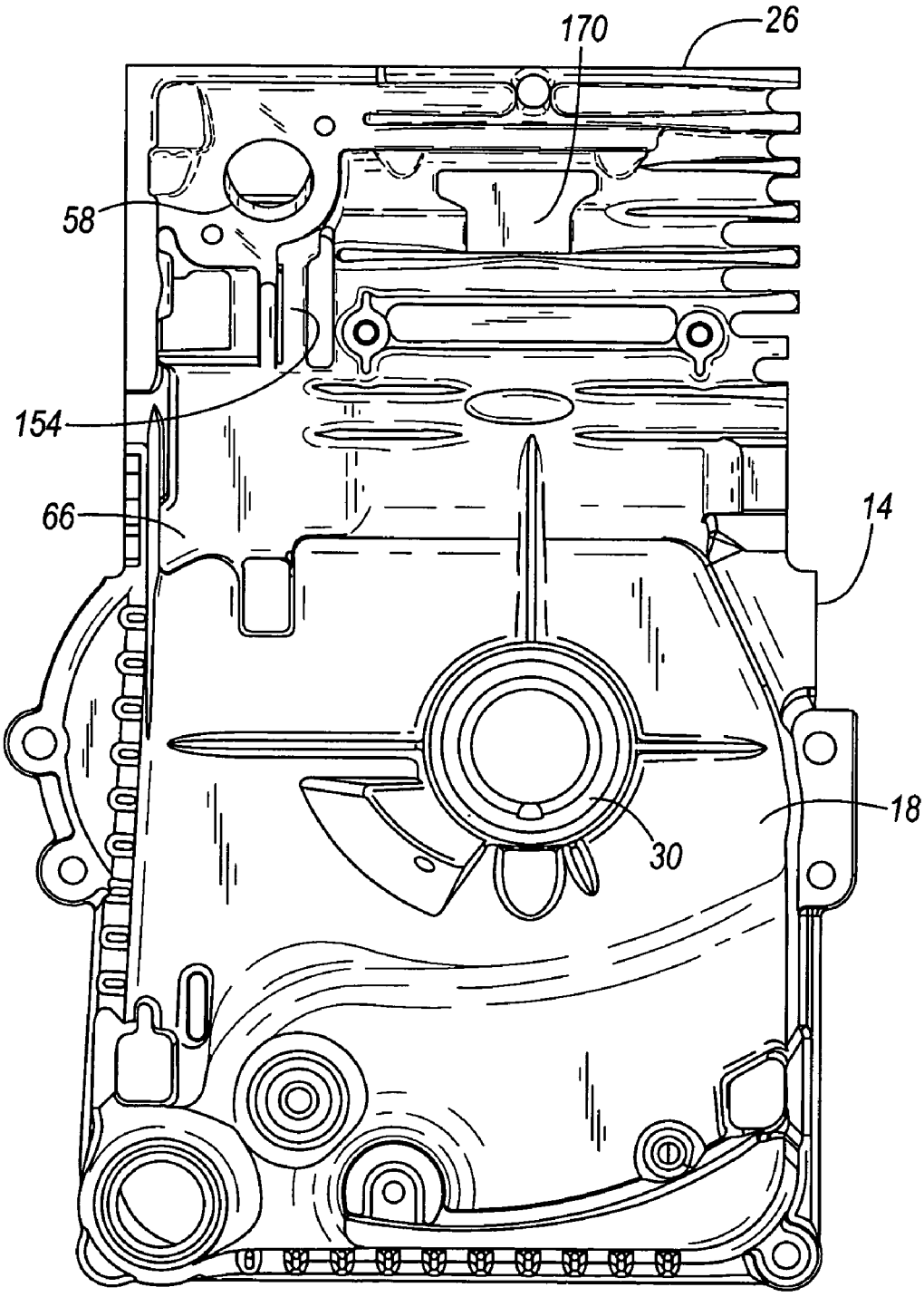
FIG. 2 is a top view of an engine housing of the engine of FIG. 1, illustrating an intake opening and a reinforced cylinder bore.
Figure 3:
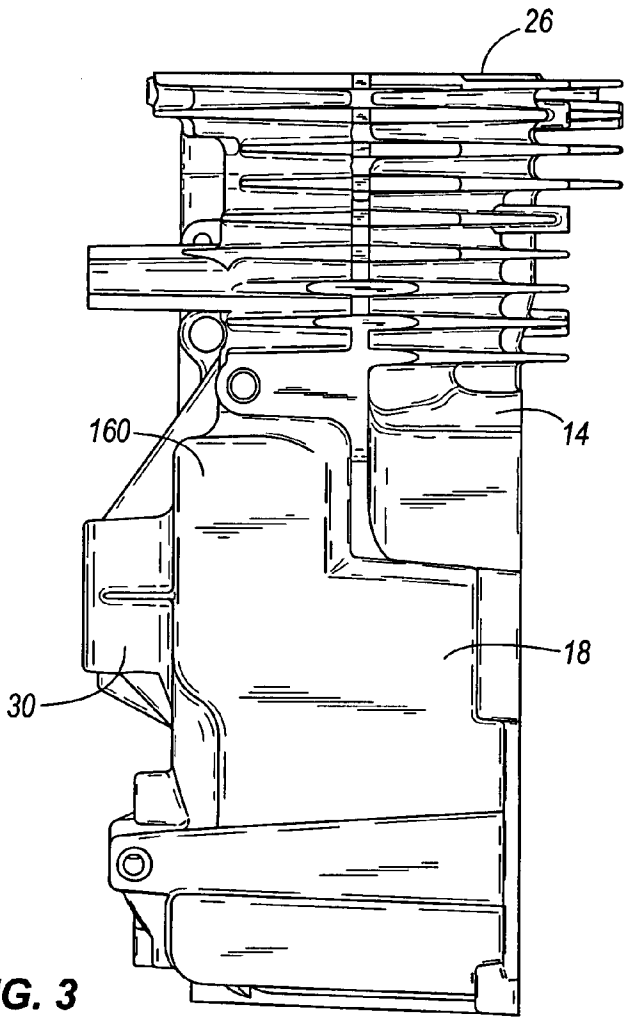
FIG. 3 is a side view of the engine housing of FIG. 2, illustrating the reinforced cylinder bore.
Figure 4:
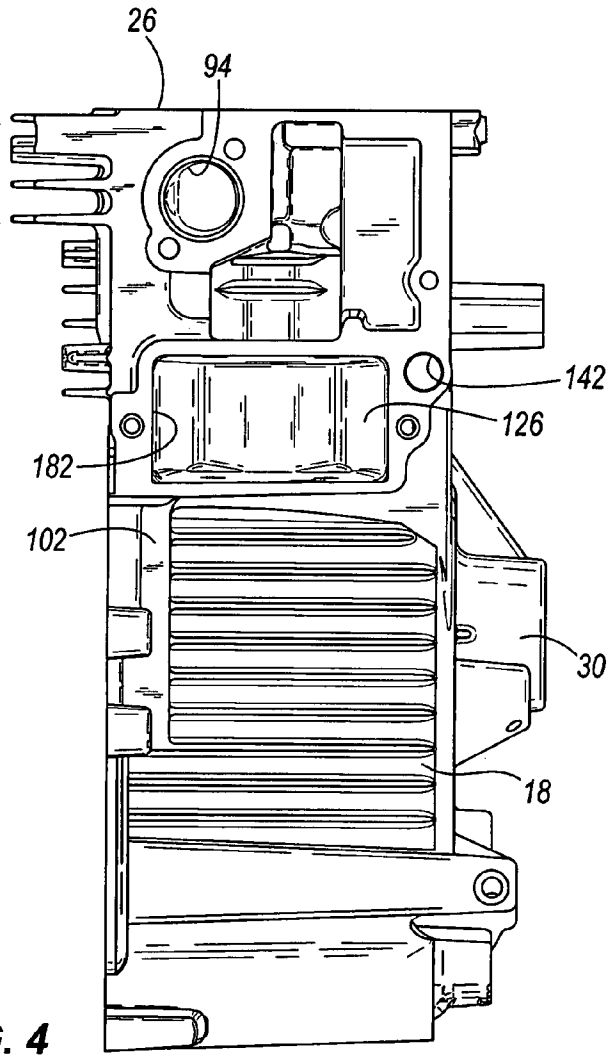
FIG. 4 is another side view of the engine housing of FIG. 2, illustrating an exhaust opening and a breather chamber.

Before any features of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having", and "comprising" and variations thereof herein is meant to encompass the items listed thereafter and equivalents thereof as well as additional items. The use of letters to identify elements of a method or process is simply for identification and is not meant to indicate that the elements should be performed in a particular order.

DETAILED DESCRIPTION

FIGS. 1–12 illustrate various features and aspects of a reduced-emission, four-cycle, single cylinder engine 10 (only a portion of which is shown). Such a "small" engine 10 may be configured with a power output as low as about 1 Hp and as high as about 20 Hp to operate engine-driven outdoor power equipment (e.g., lawn mowers, lawn tractors, snow throwers, etc.). The illustrated engine 10 is configured as an approximate 3.5 Hp single-cylinder, air-cooled engine having a displacement of about 9 cubic inches. The illustrated engine 10 is also configured as a vertical shaft engine, however, the engine 10 may also be configured as a horizontal shaft engine.

With reference to FIG. 1, the engine 10 includes an upper engine housing 14 which may be formed as a single piece by any of a number of different processes (e.g., die casting, forging, etc.). The engine housing 14 generally includes a crankcase 18 containing lubricant and a cylinder bore 22 extending from the crankcase 18. The engine housing 14 also includes a flange 26 at least partially surrounding the cylinder bore 22. The flange 26 is a substantially flat surface to receive thereon a cylinder head 28. The cylinder head 28 is fastened to the flange 26 using a plurality of bolts (not shown) around the outer periphery of the cylinder bore 22. The cylinder head 28 includes a combustion chamber which, in combination with the cylinder bore 22, is exposed to the combustion of an air/fuel mixture during operation of the engine 10.

A crankshaft 29 is rotatably supported at one end by a journal 30 (see FIG. 2) formed on the crankcase 18, and at the other end by a similar journal formed on a crankcase cover 32 coupled to the crankcase 18. A piston 34 is attached to the crankshaft 29 via a connecting rod 36 for reciprocating movement in the cylinder bore 22 as is understood in the art.

The illustrated engine 10 is also configured as a side-valve or an L-head engine including a valve train incorporating a cam shaft gear 202 driven by a crankshaft gear 206 and a cam shaft 210 coupled to the cam shaft gear 202. The cam shaft 210 includes intake and exhaust cam lobes 214, 218 thereon, and respective intake and exhaust valves 50, 54 supported in the engine housing 14 for reciprocating movement engage the respective cam lobes 214, 218 on the cam shaft 210.

The engine 10 may also include a lubrication system to provide lubricant to the working or moving components of the engine 10. As is understood in the art, the lubrication system may include a dipper or splasher (not shown) coupled to the connecting rod such that rotation of the crankshaft causes the dipper or splasher to be intermittently submerged into the lubricant held in the crankshaft. Such motion results in a lubricant mist circulated throughout the crankcase to lubricate the working components or the moving components of the engine 10. Alternatively, a slinger may be drivably coupled to the crankshaft or cam shaft to generate the lubricant mist as is understood in the art.

Figure 7A:
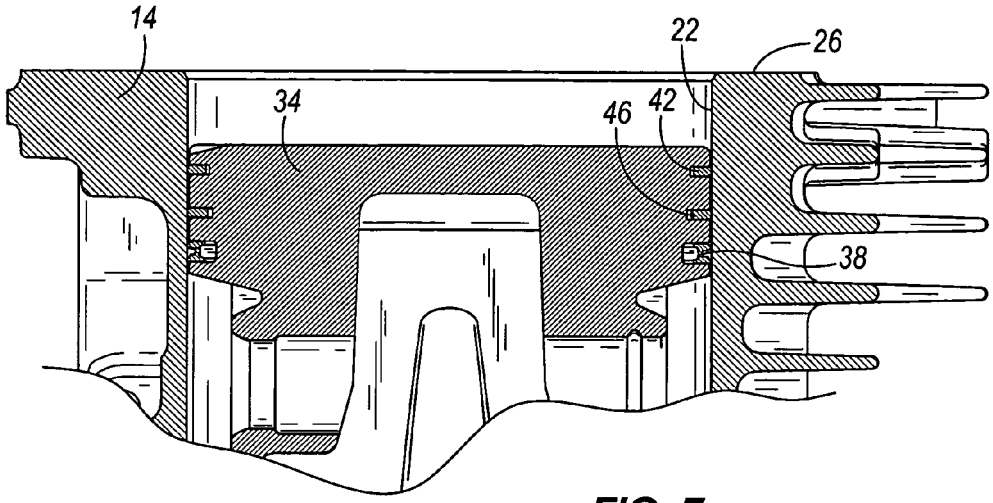
FIG. 7*a* is an enlarged, cross-sectional view of the engine housing of FIG. 5 through section line 7*a*—7*a*, illustrating the interface between the piston rings and the cylinder bore.
Figure 7B:
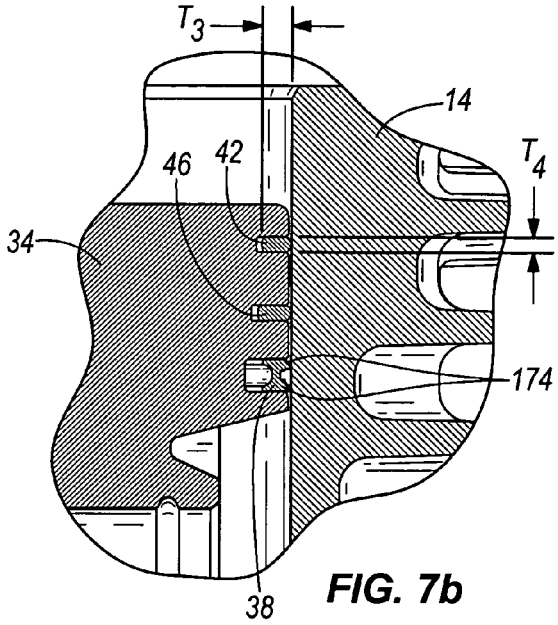
FIG. 7*b* is an enlarged view of the piston rings and the cylinder bore illustrated in FIG. 7*a*.

With reference to FIG. 7*a*, the piston 34 includes multiple piston rings 38, 42, 46 axially spaced on the piston 34. The lowest piston ring (as seen on FIGS. 7*a* and 7*b*), or the oil control ring 38, is utilized to wipe lubricant from the cylinder bore 22 so that the lubricant is substantially prevented from mixing with the air/fuel mixture or the spent exhaust gases in contact with the upper portion of the piston 34. The piston rings 42, 46 positioned above the oil control ring 38, or the compression rings 42, 46, are biased against the cylinder bore 22 to substantially seal the portion of the cylinder bore 22 above the piston 34 from the portion of the cylinder bore 22 below the piston 34. As such, the compression rings 42, 46 allow the piston 34 to generate compression in the combustion chamber. Reference is made to U.S. Pat. No. 5,655,433, the entire contents of which is hereby incorporated by reference, for additional discussion relating to additional features and aspects of pistons and piston rings.

Figure 6:
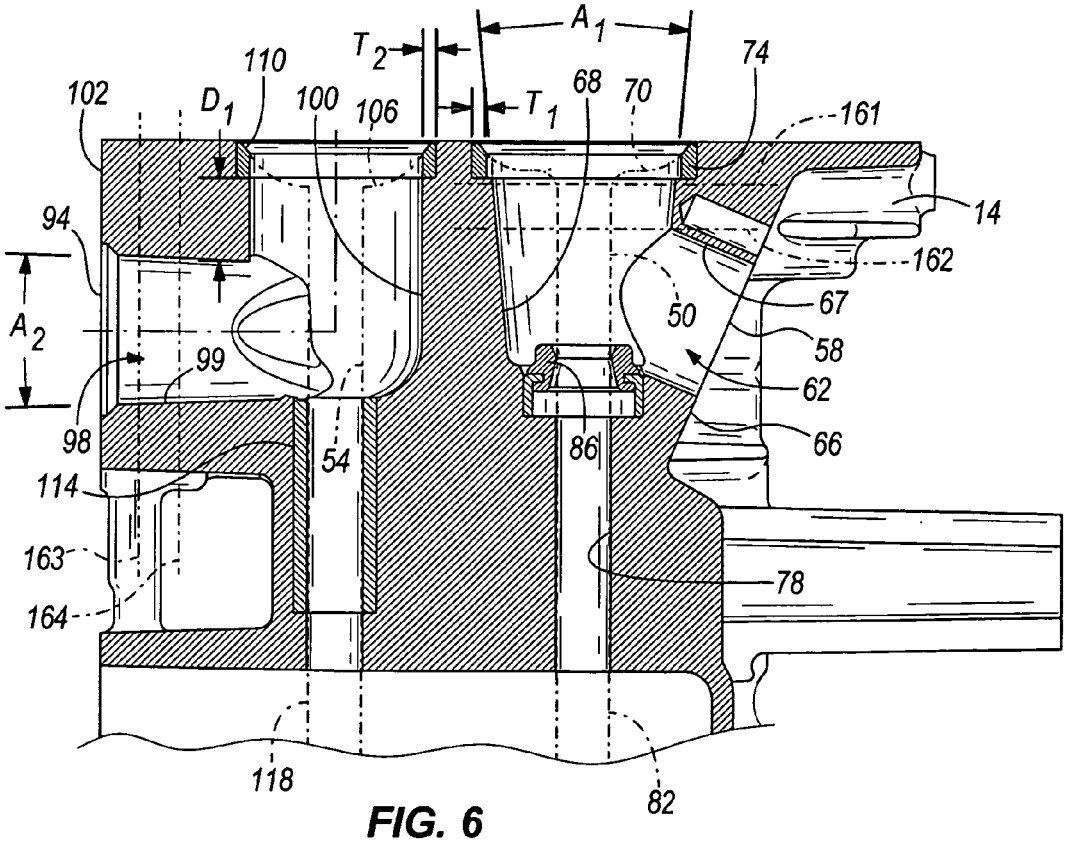
FIG. 6 is a section view of the engine housing of FIG. 2 through section line 6—6, illustrating tapered intake and exhaust passageways.

With reference to FIG. 6, the engine housing 14 includes an intake opening 58 and an intake passageway 62 downstream of the intake opening 58. The intake opening 58 is positioned on a first side 66 of the engine housing 14. The intake passageway 62 is formed of an intake runner 67 downstream of the intake opening 58, and an intake port 68 downstream of the intake runner 67. The intake valve 50 is positioned in the intake port 68, such that during operation of the engine 10, reciprocating movement of the intake valve 50 allows an air/fuel mixture air to intermittently be drawn through the intake opening 58, through the intake passageway 62, past a head 70 of the intake valve 50, and into the combustion chamber of the cylinder head 28 and the cylinder bore 22 for compression and combustion.

An intake valve seat insert 74 is coupled to the engine housing 14 by press-fitting or any other known method. The intake valve seat insert 74 includes a chamfered inner peripheral edge that sealingly engages the head 70 of the intake valve 50 to block the entrance of air/fuel mixture into the combustion chamber and the cylinder bore 22. A valve spring (not shown) may be coupled to the intake valve 50 to bias the intake valve 50 to a "closed" position, in which the head 70 of the intake valve 50 is engaged with the intake valve seat insert 74 to block the intake passageway 62. The intake valve seat insert 74 may be made from a material that is harder and/or more heat resistant than the material of the engine housing 14.

The intake valve 50 is supported in the engine housing 14 for reciprocating movement by a guide 78 integral with the housing 14. More particularly, a stem portion 82 of the intake valve 50 is supported by the guide 78. As shown in FIG. 6, a stem seal 86 is coupled to the engine housing 14 to receive the stem portion 82 of the intake valve 50. The stem seal 86 is operable to wipe the stem portion 82 as the intake valve 50 reciprocates, such that lubricant on the stem portion 82 is substantially prevented from entering the combustion chamber. Reference is made to U.S. Pat. No. 6,202,616, which is incorporated herein by reference, for additional discussion relating to the structure and operation of the stem seal 86.

The intake passageway 62 may also be in communication with an induction system to provide the air/fuel mixture. Such an induction system may include, for example, an air cleaner (not shown), a carburetor (not shown), and an intake manifold 90 containing an inlet crossover passageway (see FIG. 9). The air cleaner filters the intake air, the carburetor adds fuel to the intake air, and the inlet crossover passageway directs the air/fuel mixture to the intake opening 58.

With reference to FIG. 6, the engine housing 14 also includes an exhaust opening 94 and an exhaust passageway 98 upstream from the exhaust opening 94. The exhaust opening 94 is positioned on a second side 102 of the engine housing 14 adjacent the first side 66 of the engine housing 14 having the intake opening 58. The exhaust passageway 98 is formed of an exhaust runner 99 upstream of the exhaust opening 58, and an exhaust port 100 upstream of the exhaust runner 99. The exhaust valve 54 is positioned in the exhaust port 100, such that during operation of the engine 14, reciprocating movement of the exhaust valve 54 allows spent exhaust gases to intermittently pass out of the combustion chamber and the cylinder bore 22, past a head 106 of the exhaust valve 54, through the exhaust passageway 98, and through the exhaust opening 94.

An exhaust valve seat insert 110 is coupled to the engine housing 14 by press-fitting or other known methods. The exhaust valve seat insert 110 includes a chamfered inner peripheral edge that sealingly engages the head 106 of the exhaust valve 54 to block spent exhaust gases from exiting the combustion chamber and the cylinder bore 22. A valve spring (not shown) may be coupled to the exhaust valve 54 to bias the exhaust valve 54 to a "closed" position, in which the head 106 of the exhaust valve 54 is engaged with the exhaust valve seat insert 110 to block the exhaust passageway 98. The exhaust valve seat insert 110 may be made from a material that is harder and/or more heat resistant than the material of the engine housing 14.

The exhaust valve 54 is supported in the engine housing 14 for reciprocating movement by a valve guide 114 positioned in the housing 14. More particularly, a stem portion 118 of the exhaust valve 54 is supported by the valve guide 114. Like the exhaust valve seat insert 110, the valve guide 114 may be made from material that is harder and/or more heat resistant than the material of the engine housing 14. As such, the valve guide 114 supporting the stem portion 118 of the exhaust valve 54 may lead to improved sealing of the exhaust valve 54 and the exhaust valve seat 110.

The exhaust passageway 98 may also be in communication with an exhaust system (not shown) to discharge the spent exhaust gases. Such an exhaust system may include, for example, an exhaust manifold receiving the spent exhaust gases from the exhaust opening 94 and a muffler.

Figure 8:
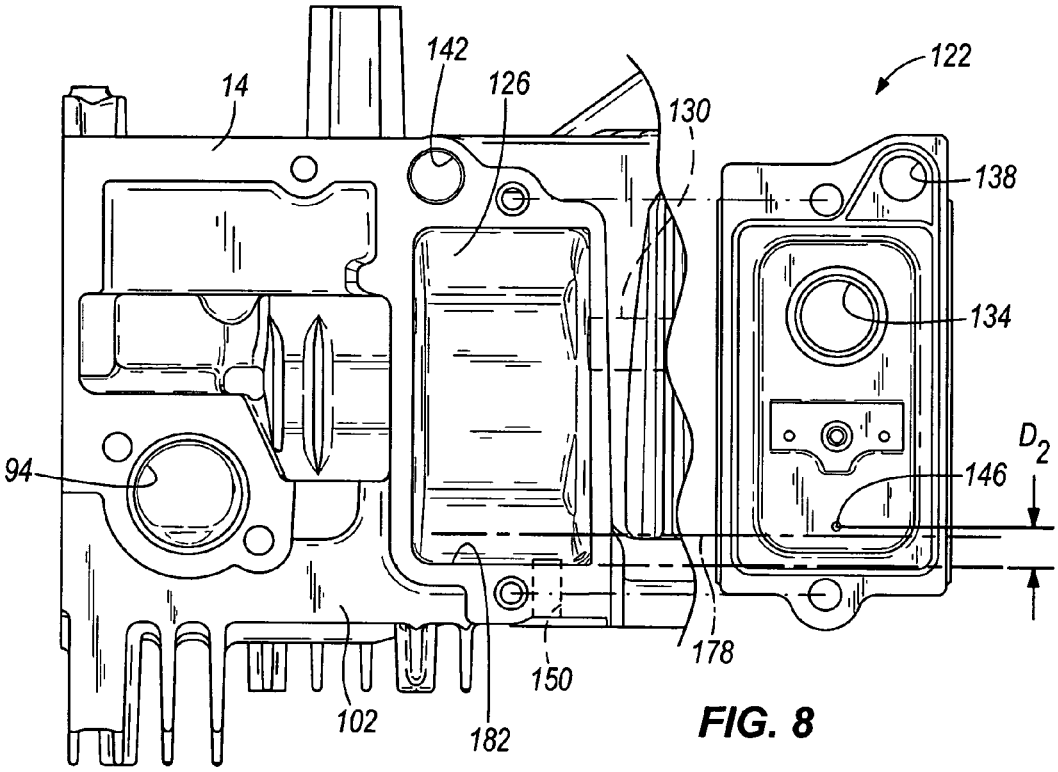
FIG. 8 is an enlarged view of the engine housing of FIG. 2, illustrating a breather exploded from the breather chamber.

With reference to FIG. 8, the engine 10 may also include a breather 122 engageable with a breather chamber 126 formed in the engine housing 14. The breather 122 generally removes lubricant entrained in an air/lubricant mixture (i.e., the lubricant mist) present in the crankcase 18. During operation of the engine 10, a quantity of air/lubricant mixture is displaced from the crankcase 18 into the breather chamber 126 via an inlet passageway 130 when crankcase pressure increases during the power stroke or the intake stroke of the piston 34 (i.e., during a downward stroke of the piston 34, as shown in FIG. 7*a*).

As shown in FIG. 8, the breather 122 includes an air/lubricant inlet 134 to receive the air/lubricant mixture or breather gases in the breather chamber 126. The breather 122 includes internal baffling structure to separate the entrained lubricant from the oil-laden breather gases. The baffling structure causes the entrained lubricant to precipitate out of the mixture and accumulate in the bottom of the breather 122, while the breather gases are discharged from the breather 122 via a first outlet 138. The engine housing 14 includes a passageway 142 for recirculating the breather gases from the breather 122 to the induction system downstream of the air cleaner so the breather gases may be burned by the engine 10.

The breather 122 also includes a second outlet 146 positioned toward the bottom of the breather 122 (as shown in FIG. 8). The separated lubricant is discharged from the breather 122 via the second outlet 146 and returned to the breather chamber 126. The breather chamber 126 includes a drain 150 communicating the breather chamber 126 with the crankcase 18, such that the separated lubricant may drain from the breather chamber 126 back to the crankcase 18 for reuse by the engine 10.

It is expected that various combinations of features and aspects of the engine 10 will enable the engine 10, without using a sophisticated fuel injection system or expensive exhaust catalysts, to operate at decreased levels of hydrocarbon emissions compared to other four-cycle single cylinder small engines. It is expected that various combinations of features and aspects of the engine 10 as described herein will reduce the amount of hydrocarbon emissions output by about 50 percent without using a sophisticated fuel injection system or expensive exhaust catalysts.

With reference to FIG. 6, the engine 10 utilizes a valve sealing arrangement that is expected to decrease hydrocarbon emissions output of the engine. In the illustrated construction, the intake valve seat insert 74 has a radial thickness $T_1$ between about 1.8 mm and about 2.2 mm, while the exhaust valve seat insert 110 has a radial thickness $T_2$ between about 1.8 mm and about 2.2 mm. In some embodiments of the engine 10, the axial thickness of the intake valve seat insert 74 is equal to about twice the radial thickness $T_1$. In other embodiments of the engine 10, the axial thickness of the exhaust valve seat insert 110 is equal to about twice the radial thickness $T_2$.

By sizing the radial thickness of the intake and exhaust valve seat inserts 74, 110 according to the above-referenced values, the inserts 74, 110 present less of a barrier to the dissipation of heat from the valves 50, 54 since the heat conducts through a shorter distance before reaching the engine housing 14. As such, less heat may be "trapped" by the inserts 74, 110 and a more uniform dissipation of heat from the valves 50, 54 may occur, resulting in reduced temperature and decreased warpage or distortion of the inserts 74, 110 and the valves 50, 54. Further, it is expected that sizing the radial thickness of the intake and exhaust valve seat inserts 74, 110 according to the above-referenced values may allow more effective sealing of the intake and exhaust valves 50, 54 and the respective inserts 74, 110 during engine operation, potentially prolonging the useful life of the engine 10, increasing the performance of the engine 10, and decreasing the hydrocarbon emissions output of the engine 10.

The valve sealing arrangement may also include spacing the intake and exhaust valve seat inserts 74, 110 by a wall thickness W between about 2.5 mm and about 5 mm. By sizing the wall thickness W according to the above-referenced values, heat transfer between the inserts 74, 110 may be reduced, allowing more uniform temperatures of the inserts 74, 110. As a result, more uniform temperatures of the inserts 74, 110 may reduce warpage or distortion of the inserts 74, 110 during operation of the engine 10. Further, sizing the wall thickness W according to the above-referenced values may lead to improved sealing of the intake and exhaust valves 50, 54 and the respective inserts 74, 110 during operation of the engine 10. It is therefore expected that such improved valve sealing may lead to prolonging the useful life of the engine 10, increasing the performance of the engine 10, and decreasing the hydrocarbon emissions output of the engine 10.

The valve sealing arrangement may also include positioning the valve guide 114 in a reinforced portion of the engine housing 14 to stabilize the valve guide 114, and therefore, support the stem portion 118 of the exhaust valve 54 to stabilize the reciprocating movement of the exhaust valve 54. In addition, the valve sealing arrangement may include reinforcing a portion of the engine housing 14 to provide additional support to the stem portion 82 of the intake valve 50 to stabilize reciprocating movement of the intake valve 50. More particularly, with reference to FIG. 2, a rib 154 is formed on a portion of the engine housing 14 supporting the stem portion 82 of the intake valve 50. The rib 154 may substantially prevent undesirable lateral movement of the intake valve 50 during operation of the engine 10. By stabilizing the intake and exhaust valves 50, 54 during reciprocating movement, more effective sealing is promoted between the valve head 106 and the intake and exhaust valve seat inserts 74, 110 during engine operation. As such, the useful life of the engine 10 may be prolonged, performance of the engine 10 may be increased, and the hydrocarbon emissions output of the engine 10 may be decreased.

With reference to FIG. 6, the valve sealing arrangement may further include positioning the stem seal 86 in sliding contact with the stem portion 82 of the intake valve 50 during reciprocating movement of the intake valve 50. As discussed above, the stem seal 86 wipes the stem portion 82 of the intake valve 50 to substantially prevent lubricant from entering the intake passageway 62 and being drawn into the combustion chamber for combustion with the air/fuel mixture. Such combustion of lubricant may result in an increased hydrocarbon emissions output. By substantially sealing the lubricant from the intake passageway 62 and thus the combustion chamber, the useful life of the engine 10 may be prolonged, performance of the engine 10 may be increased, and the hydrocarbon emissions output of the engine 10 may be decreased.

The valve sealing arrangement may also include spacing the exhaust opening 94 and the exhaust runner 99 a dimension D1. High temperature exhaust gases are discharged from the exhaust opening 94. As such, spacing the exhaust opening 94 and the exhaust valve seat insert 110 by dimension D1 may facilitate more uniform cooling and/or a lower temperature of the exhaust valve seat insert 110. With reference to FIG. 6, the exhaust runner 99 is spaced from the exhaust valve seat insert 110 by a dimension D1 between about 6 mm and about 12 mm. By spacing the exhaust runner 99 and the exhaust valve seat insert 110 according to the above-referenced values, more uniform cooling or lower temperatures of the exhaust valve seat insert 110 may result which, in turn, may promote more effective sealing of the exhaust valve 54 and the exhaust valve seat insert 110 during engine operation. As such, the life of the engine 10 may be prolonged, performance of the engine 10 may be increased, and the hydrocarbon emissions output of the engine 10 may be decreased.

Figure 5:
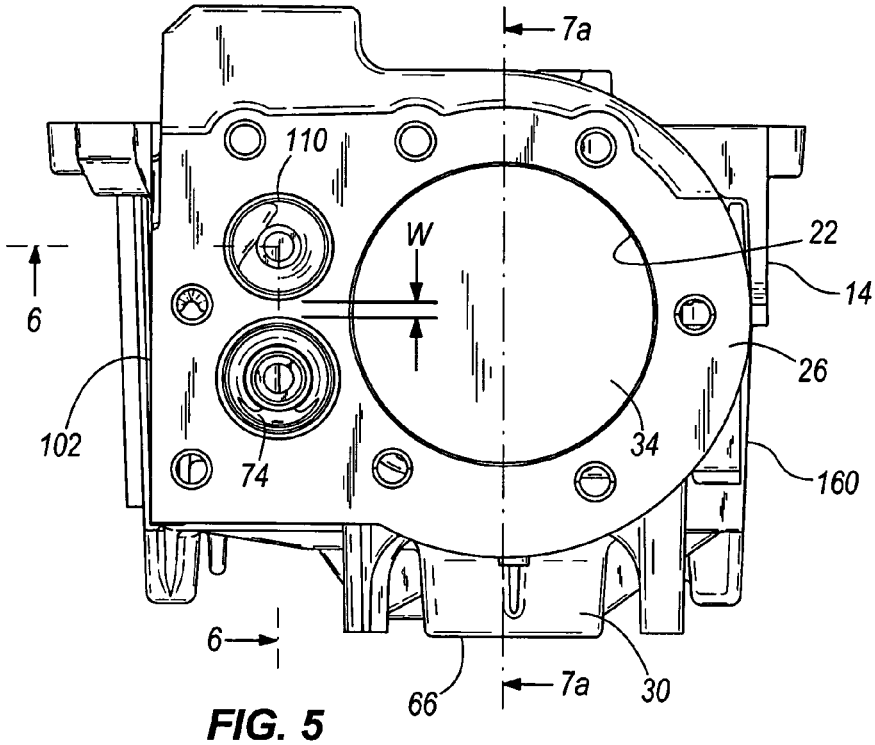
FIG. 5 is an end view of the engine housing of FIG. 2, illustrating a piston positioned within the cylinder bore of the engine housing.
Figure 9:
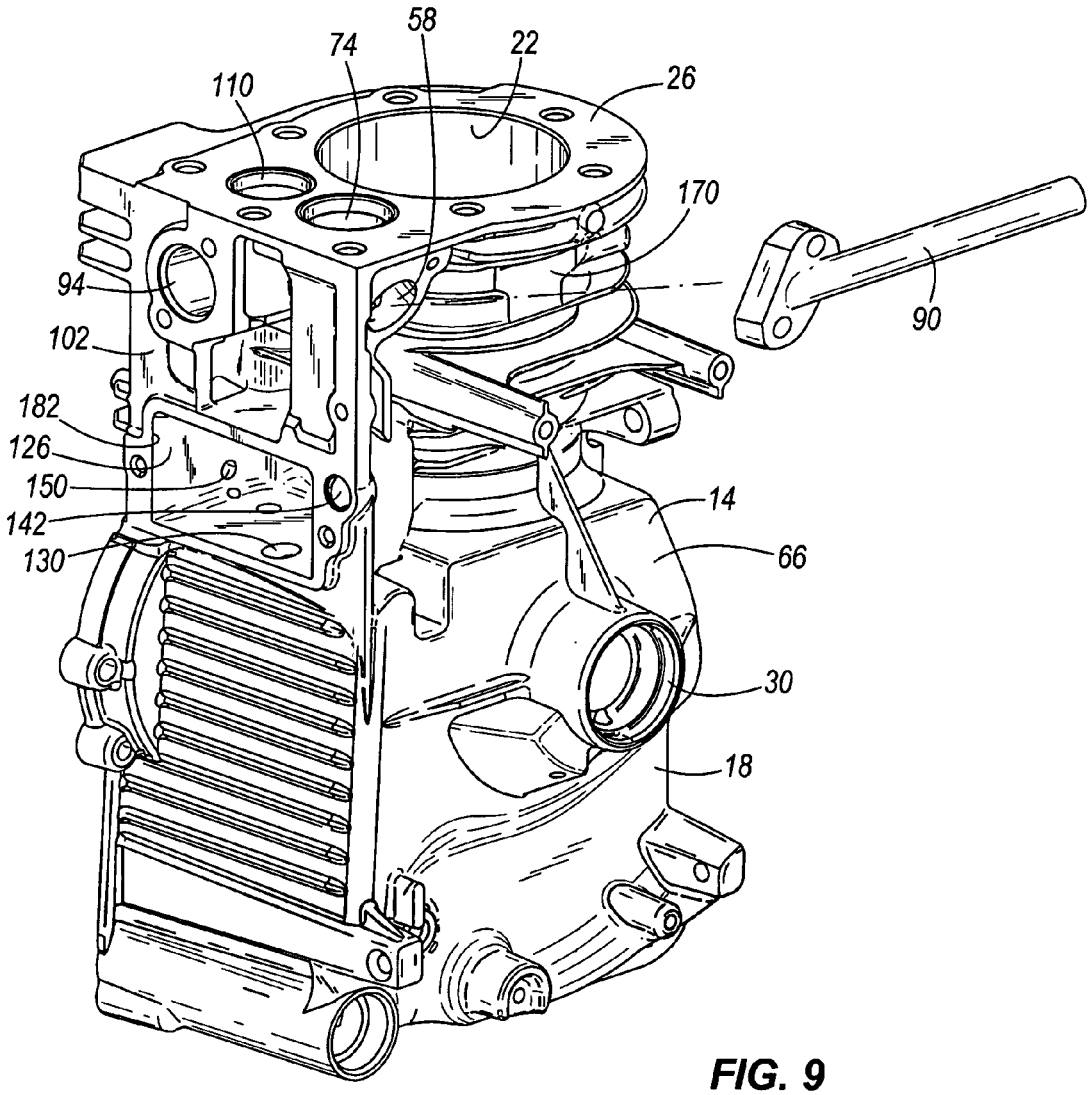
FIG. 9 is an enlarged, top perspective view of the engine housing of FIG. 2 illustrating an intake crossover passageway exploded from the engine housing.

With reference to FIGS. 5, 6, and 9, the engine 10 utilizes an air flow arrangement that is expected to decrease hydrocarbon emissions output of the engine 10. The air flow arrangement includes forming the inlet crossover passageway in the intake manifold 90 (see FIG. 9) such that the inlet crossover passageway has a substantially constant cross-sectional area along the its length to increase the flow efficiency of the intake air therethrough. Reference is made to U.S. patent application Ser. No. 10/779,363 filed Feb. 13, 2004, the entire contents of which is incorporated herein by reference, for additional discussion relating to the inlet crossover passageway. The inlet crossover passageway may define a constant cross-sectional shape, and thus a constant cross-sectional area, or the inlet crossover passageway may define a varying cross-sectional shape while maintaining a constant cross-sectional area. By increasing the flow efficiency of the intake air and/or the air/fuel mixture through the inlet crossover passageway, more efficient combustion may result during operation of the engine 10. It is therefore expected that such improved air flow may result in increased performance of the engine 10 and decreased hydrocarbon emissions output of the engine 10.

Also, the inlet crossover passageway draws intake air from a location spaced from the exhaust opening 94. More particularly, the inlet crossover passageway draws intake air from a location adjacent a third side 160 of the engine housing 14 opposite the second side 102. This enables the engine 10 to draw a cooler intake charge (i.e., the air/fuel mixture) into the combustion chamber.

With reference to FIG. 6, the intake passageway 62 has first and second cross-sectional areas defined by respective first and second planes 161, 162 passing substantially transversely through the intake passageway 62. The first cross-sectional area is larger than the second cross-sectional area and disposed further from the intake opening 58 than the second cross-sectional area to increase flow efficiency of the intake air and/or the air/fuel mixture through the intake passageway 62. In the illustrated construction, the intake port 68 has a conical shape defining an included angle $A_1$ between about 8 degrees and about 15 degrees. By increasing the flow efficiency of the intake air and/or the air/fuel mixture through the intake passageway 62, more efficient combustion may result during operation of the engine 10. It is therefore expected that such improved air flow may result in increased performance of the engine 10 and decreased hydrocarbon emissions output of the engine 10.

Likewise, the exhaust passageway 98 has third and fourth cross-sectional areas defined by respective third and fourth planes 163, 164 passing substantially transversely through the exhaust passageway 98. The third cross-sectional area is larger than the fourth cross-sectional area and disposed closer to the exhaust opening 94 than the fourth cross-sectional area to increase flow efficiency of exhaust gases through the exhaust passageway 98. In the illustrated construction, the exhaust runner 99 has a conical shape defining an included angle $A_2$ between about 4 degrees and about 10 degrees. By increasing the flow of exhaust gases through the exhaust passageway 98, more efficient combustion may result during operation of the engine 10. It is therefore expected that such improved air flow may result in increased performance of the engine 10 and decreased hydrocarbon emissions output of the engine 10.

With reference to FIG. 9, the engine 10 utilizes a lubricant control arrangement that is expected to decrease hydrocarbon emissions output of the engine 10. With reference to FIG. 9, the lubricant control arrangement includes reinforcing a portion 170 of the engine housing 14 adjacent the flange 26 to decrease deflection of the flange 26 and/or deflection of the cylinder bore 22 during operation of the engine 10. The reinforced portion 170 of the engine housing 14 is on the first side 66 of the engine housing 14 in a location that is covered by the intake manifold 90 when the intake manifold 90 is coupled to the engine housing 14.

By not sufficiently reinforcing the portion of the engine housing 10 adjacent the flange 26, deflection of the flange 26 and/or the cylinder bore 22 may occur due to the forces exerted on the cylinder head 28 during engine operation. More particularly, the forces exerted on the cylinder head 28 during engine operation want to separate the cylinder head 28 from the engine housing 14. However, the cylinder head 28 is secured to the engine housing 14 by multiple bolts. As a result, the forces are absorbed by the engine housing 14. Insufficient reinforcement around the cylinder bore 22 may allow the cylinder bore 22 to deflect, which may prevent the piston rings 38, 42, 46 from effectively sealing against the cylinder bore 22 during engine operation. If the piston rings 38, 42, 46 do not effectively seal against the cylinder bore 22, lubricant may be allowed to enter the combustion chamber where it is burnt. The burned lubricant, therefore, may create deposits on the piston 34 or in the combustion chamber that may likely result in decreased performance of the engine 10 and increased hydrocarbon emissions output of the engine 10.

However, by providing the reinforced portion 170 in the engine housing 14, the cylinder bore 22 is less likely to deflect during operation of the engine 10. Further, the reinforced portion 170 of the engine housing 14 may lead to improved sealing of the piston rings 38, 42, 46 to the cylinder bore 22 during engine operation, thereby reducing the amount of lubricant that enter the cylinder bore 22 and combustion chamber. Such improved sealing of the piston rings 38, 42, 46 to the cylinder bore 22 during combustion may also reduce blow-by of combustion gases into the crankcase 18. It is therefore expected that such improved lubricant control may lead to prolonging the useful life of the engine 10, increasing the performance of the engine 10, and decreasing the hydrocarbon emissions output of the engine 10.

With reference to FIG. 7*a*, the lubricant control arrangement also includes sizing the radial thickness of the compression rings 42, 46 to facilitate radially outward deflection of the compression rings 42, 46 to more effectively seal against the cylinder bore 22. In the illustrated construction, the radial thickness $T_3$ of the compression rings 42, 46 may be between about 2.3 mm and about 2.7 mm.

The lubricant control arrangement further includes sizing the axial thickness of the compression rings 42, 46 to facilitate sealing against the cylinder bore 22. In the illustrated construction, the axial thickness $T_4$ of the compression rings 42, 46 may be between about 1 mm and about 1.5 mm. By providing compression rings 42, 46 of decreased radial and axial thickness, lubricant is less likely to enter the combustion chamber during engine operation. It is therefore expected that such improved lubricant control may lead to prolonging the useful life of the engine 10, increasing the performance of the engine 10, and decreasing the hydrocarbon emissions output of the engine 10.

The lubricant control arrangement also includes utilizing the oil control ring 38 to wipe lubricant from the cylinder bore 22 preferentially during the power stroke and the intake stroke of the engine 10. In other words, the oil control ring 38 is configured to wipe oil from the cylinder bore 22 preferentially in one direction. In the illustrated construction, the oil control ring 38 includes two wipers 174 biased against the cylinder bore 22 and downwardly angled to wipe oil from the cylinder bore 22 to return the oil to the crankcase 18. Some oil control rings utilize wipers configured to wipe oil from the cylinder as the piston reciprocates both upward and downward. Such a configuration may be less efficient in wiping lubricant from the cylinder, and some lubricant may be allowed to enter the combustion chamber.

By providing the oil control ring 38 having directional wipers 174, lubricant is less likely to enter the combustion chamber during engine operation. It is therefore expected that such improved lubricant control may lead to prolonging the useful life of the engine 10, increasing the performance of the engine 10, and decreasing the hydrocarbon emissions output of the engine 10.

With reference to FIG. 8, the lubricant control arrangement further includes positioning the second outlet 146 in the breather 122 above the level of accumulated lubricant (represented by line 178) in the breather chamber 126. In the illustrated construction, the second outlet 146 is positioned a dimension D2 of at least 6 mm from a lower-most wall 182 in the breather chamber 126 such that the second outlet 146 remains substantially above the separated lubricant accumulated in the breather chamber 126 during operation of the engine 10. Positioning the second outlet 146 as shown in FIG. 8 also allows the engine 10 to be tipped during normal operation without substantially submerging the second outlet 146 in the accumulated lubricant in the breather chamber 126.

If the second outlet 146 is positioned substantially below the level illustrated in FIG. 8, pressure pulses in the breather chamber 126 due to the reciprocating motion of the piston 34 may cause the accumulated lubricant to re-enter the breather 122 via the second outlet 146. If the accumulated lubricant is allowed to re-enter the breather 122, the lubricant may become re-mixed with the air in the breather 122 and discharged from the air outlet 138 for re-introduction into the engine 10. If this is allowed to occur, lubricant may be allowed to enter the combustion chamber where it may be burnt. The burned lubricant, therefore, may create deposits on the piston 34 and/or in the combustion chamber that may likely result in decreased performance of the engine 10 and increased hydrocarbon emissions output of the engine 10.

However, by providing the improved breather 122 having the second outlet 146 spaced sufficiently far from the lowermost wall 182 in the breather chamber 126, accumulated lubricant is less likely to re-enter the breather 122 via the second outlet 146, thereby more effectively preventing lubricant from entering the combustion chamber and being burned. It is therefore expected that such improved lubricant control may lead to prolonging the useful life of the engine 10, increasing the performance of the engine 10, and decreasing the hydrocarbon emissions output of the engine 10.

In addition, the second outlet 146 is sized to control air leakage back into the crankcase 18. More particularly, the second outlet 146 is formed as a circular aperture having a diameter between about 0.5 mm and about 2 mm, which yields a flow area of between about 0.2 $mm^2$ and about 3.1 $mm^2$, and the inlet 134 is formed as a circular aperture yielding a flow area substantially larger than the flow area of the second outlet 146. Sizing the second outlet 146 as described above increases the efficiency of the breather 122 by decreasing the amount of oil-laden breather gases that leak through the second outlet 146, while facilitating the precipitated oil in the breather 122 to drain into the breather chamber 126 through the second outlet 146.

With reference to FIGS. 7*a*–8, the engine 10 utilizes a crankcase breather arrangement that is expected to decrease hydrocarbon emissions output of the engine 10. More particularly, with reference to FIG. 7*a*, the crankcase breather arrangement includes sizing the radial thickness of the compression rings 42, 46 to facilitate radially outward deflection of the compression rings 42, 46 to more effectively seal against the cylinder, as discussed above. The crankcase breather arrangement also includes sizing the axial thickness of the compression rings 42, 46 to facilitate sealing against the cylinder, as discussed above.

By sizing the compression rings 42, 46 according to the above values, the piston 34 may be more effectively sealed against the cylinder bore 22. As a result, it is less likely that blow-by of the combusting air/fuel mixture will occur, and that the breather 122 may function more efficiently. It is therefore expected that such improved crankcase breathing may lead to prolonging the useful life of the engine 10, increasing the performance of the engine 10, and decreasing the hydrocarbon emissions output of the engine 10.

With reference to FIG. 8, the crankcase breather arrangement also includes positioning the second outlet 146 in the breather 122 above the level of accumulated oil in the breather chamber 126, as previously discussed. By providing the improved breather 122 having the second outlet 146 spaced sufficiently far from the lower-most wall 182 in the breather chamber 126, accumulated lubricant is less likely to re-enter the breather 122 via the second outlet 146, thereby more effectively preventing lubricant from entering the combustion chamber and being burned. It is therefore expected that such improved crankcase breathing may lead to prolonging the useful life of the engine 10, increasing the performance of the engine 10, and decreasing the hydrocarbon emissions output of the engine 10.

Figure 10:
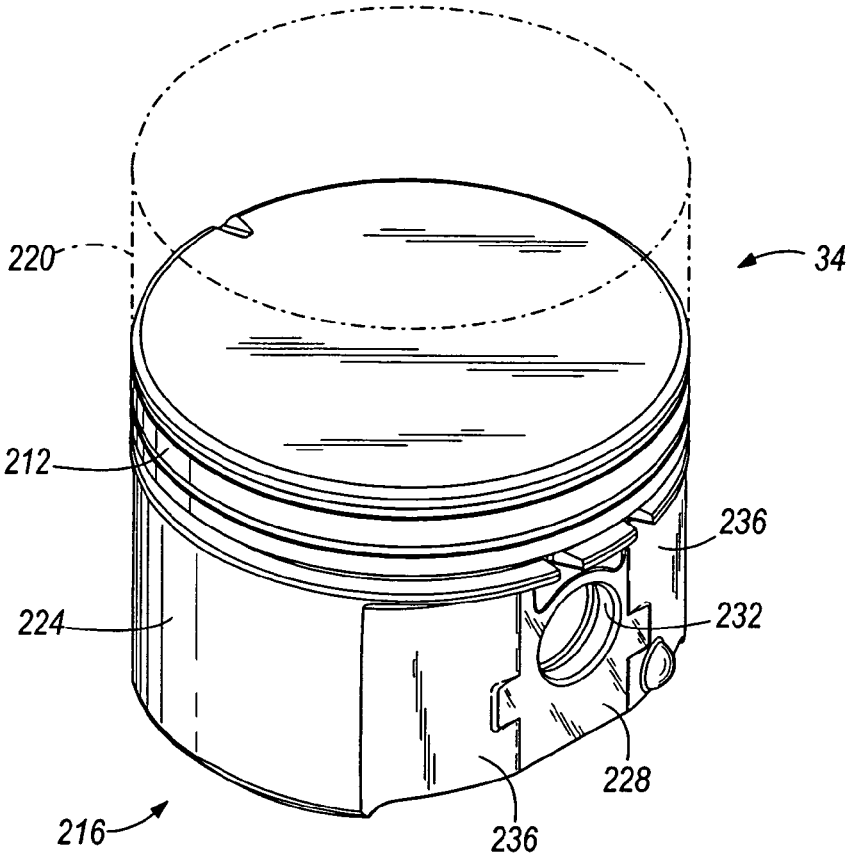
FIG. 10 is an enlarged, top perspective view of the piston of the engine of FIG. 1.
Figure 11:
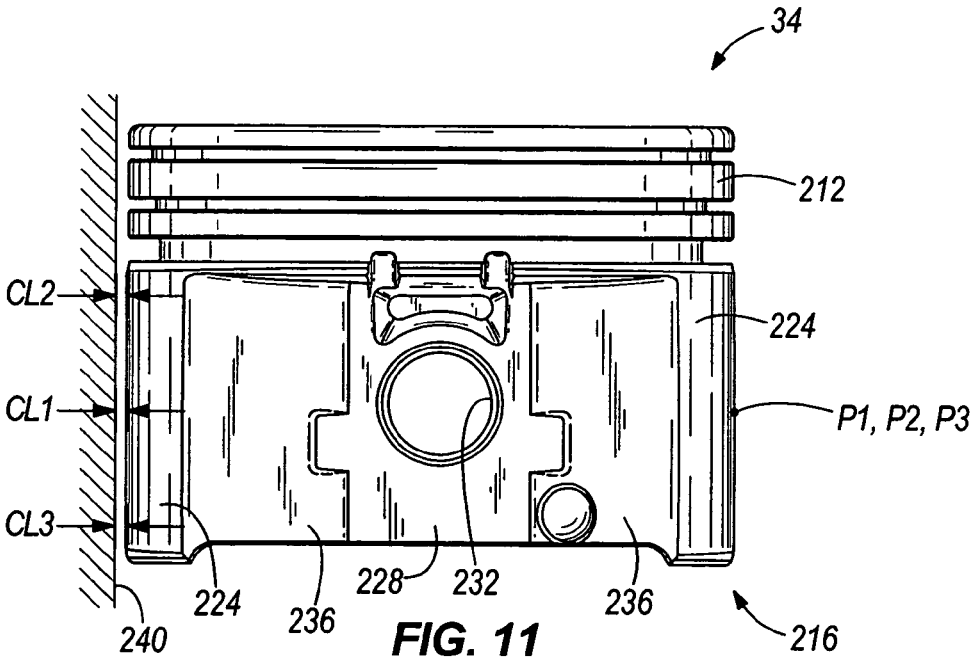
FIG. 11 is a side view of the piston of the engine of FIG. 1.
Figure 12:
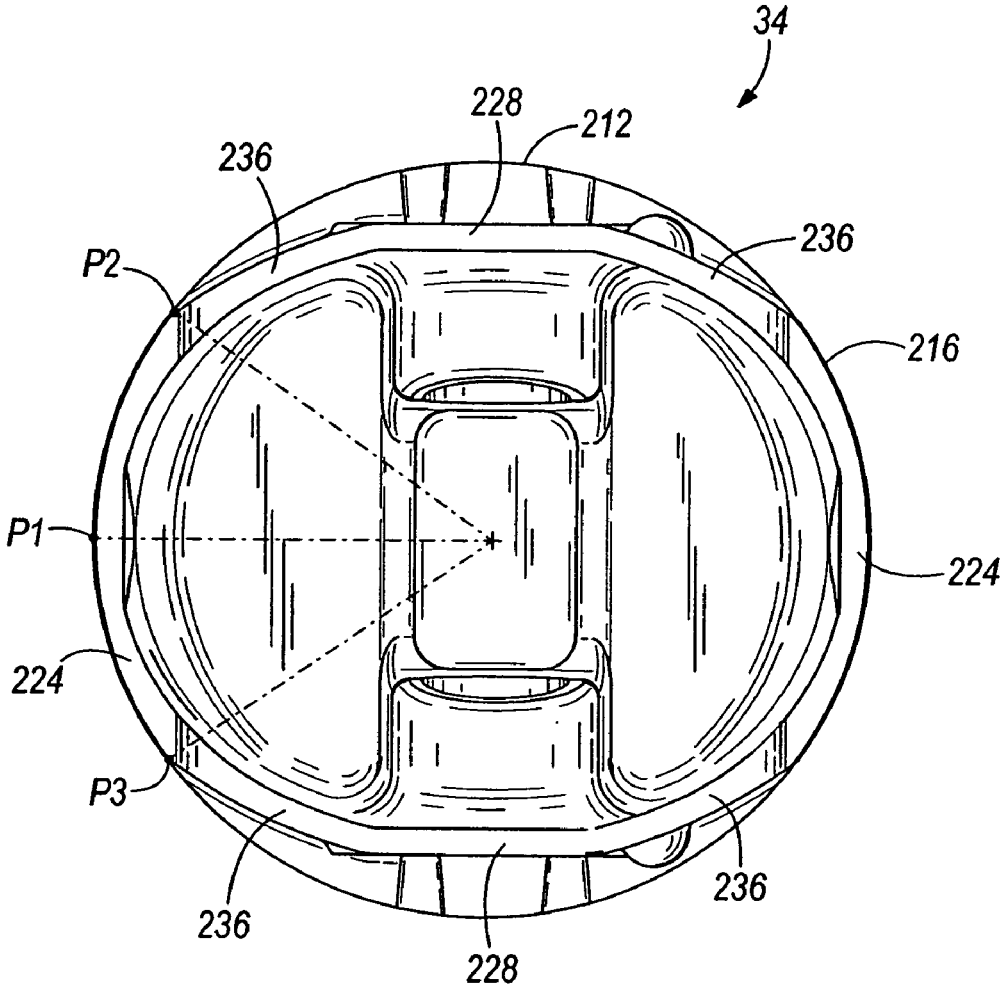
FIG. 12 is a bottom view of the piston of the engine of FIG. 1.

With reference to FIGS. 10–12, the piston 34 includes a substantially circular head portion 212 and a skirt 216 extending from the head portion 212. The substantially circular head portion 212 generally defines at its outer periphery a cylindrical plane 220 (see FIG. 10). The head portion 212 includes a plurality of grooves therein to receive the rings 38, 42, 46, as discussed above.

With continued reference to FIG. 10, the skirt 216 includes a curved first portion 224, at least a portion of which is substantially co-planar with the cylindrical plane 220. The skirt 216 also includes a substantially flat second portion 228 having an aperture 232 therethrough for receiving a connecting pin (not shown). The connecting pin rotatably couples the piston 34 to the connecting rod 36 as is understood in the art. The skirt 216 further includes a substantially elliptical third portion 236 connecting the curved first portion 224 and the substantially flat second portion 228. As shown in FIG. 12, the substantially flat second portion 228 and the substantially elliptical third portion 236 are located radially inward of the cylindrical plane 220.

With reference to FIG. 12, at least a portion of the curved first portion 224 is located radially inward of the cylindrical plane 220. Specifically, point P1 on the outer periphery of the curved first portion 224 is located on a portion of the curved first portion 224 that is coplanar with the cylindrical plane 220, while points P2, P3 on the outer periphery of the curved first portion 224 are located on respective portions of the curved first portion 224 that are spaced radially inward of the cylindrical plane 220. In other words, the spacing between the first curved portion 224 and a cylinder wall 240 of the cylinder bore 22 is the smallest at point P1, while the spacing between the curved first portion 224 and the cylinder wall 240 increases moving from point P1 to point P2, and from point P1 to point P3. In the illustrated construction, all of the points P1, P2, P3 are located in a common horizontal plane (not shown) passing through the middle of the skirt 216 (see FIG. 11).

This shape of the curved first portion 224 allows the piston 34 to be tightly fit into the cylinder bore 22 at point P1. In some constructions of the engine 10, a clearance of 0.013 mm can be used between the curved first portion 224 and the cylinder wall 240 at point P1. Points P2, P3 are located at portions of the curved first portion 224 that experience a greater amount of thermal expansion during operation of the engine 10. By spacing these portions of the curved first portion 224 inwardly from the cylinder bore 22, these portions are allowed to grow without substantially affecting operation of the engine 10. The piston 34 can be fitted tightly to the cylinder bore 22 at point P1 to provide improved stability of the piston 34 as it moves in the cylinder bore 22, while allowing adequate clearance at points P2, P3 for thermal expansion during operation of the engine 10. As a result of increasing the stability of the piston 34 in the cylinder bore 22, the movement of the piston rings 38, 42, 46 in the cylinder bore 22 can also be stabilized. It is therefore expected that such improved piston and ring stability may yield reduced oil consumption and reduced amounts of burned oil deposits on the piston 34 and/or in the combustion chamber, thereby reducing hydrocarbon emissions from the engine 10. It is also expected that such improved piston and ring stability may yield reduced blow-by of combustion gases into the crankcase 18, thereby reducing the amount of combustion gases passing through the breather 122 and into the combustion chamber. Further, it is expected that such improved piston and ring stability may lead to prolonging the useful life of the engine 10, increasing the performance of the engine 10, and decreasing the hydrocarbon emissions output of the engine 10.

With reference to FIG. 11, the first portion 224 of the skirt 216 is spaced from the cylinder wall 240 a variable clearance from an end of the skirt 216 adjacent the head portion 212 to an opposite end of the skirt 216. More particularly, the smallest clearance (indicated by CL1) between the first portion 224 of the skirt 216 and the cylinder wall 240 occurs about midway between the opposite ends of the skirt 216. Further, larger clearances (indicated by CL2 and CL3) between the first portion 224 of the skirt 216 and the cylinder wall 240 occur toward the opposite ends of the skirt 216. In the illustrated construction, clearance CL1 may be about 0.013 mm, clearance CL2 may be about 0.150 mm, and clearance CL3 may be about 0.025 mm.

As a result, the curved first portion 224, as viewed in FIG. 11, is substantially arcuate with a tight fit against the cylinder wall 240 at a location on the skirt 216 corresponding with clearance CL1. The increased clearance CL2 allows for thermal expansion of the skirt 216 toward the cylinder wall 240. The increased clearance CL3 provides additional clearance for improved lubrication between the skirt 216 and the cylinder wall 240. In operation, therefore, the resultant fit of the piston 34 provides improved stability of the piston 34 as it moves in the cylinder bore 22. As a result of increasing the stability of the piston 34 in the cylinder bore 22, the movement of the piston rings 38, 42, 46 in the cylinder bore 22 can also be stabilized. It is therefore expected that such improved piston and ring stability may yield reduced oil consumption and reduced amounts of burned oil deposits on the piston 34 and/or in the combustion chamber, thereby reducing hydrocarbon emissions from the engine 10. It is also expected that such improved piston and ring stability may yield reduced blow-by of combustion gases into the crankcase 18, thereby reducing the amount of combustion gases passing through the breather 122 and into the combustion chamber. Further, it is expected that such improved piston and ring stability may lead to prolonging the useful life of the engine 10, increasing the performance of the engine 10, and decreasing the hydrocarbon emissions output of the engine 10.

It should be understood that the reduced emission, single cylinder engine 10 of the present invention may incorporate one or more of the valve sealing arrangement, the lubricant control arrangement, the air flow arrangement, and the crankcase breather arrangement.

Various aspects of the invention are set forth in the following claims.

I claim:

1. An air flow arrangement for a reduced-emission, single cylinder engine, the arrangement comprising:

an engine housing;

an intake opening positioned on a first side of the engine housing;

an exhaust opening positioned on a second side of the engine housing adjacent the first side;

an inlet crossover passageway for introducing intake air to the engine, the inlet crossover passageway drawing intake air from a location disposed from the second side;

an intake passageway defined in the engine housing downstream of the intake opening, the intake passageway including an intake runner downstream of the intake opening and an intake port downstream of the intake runner such that an intake valve is positioned in the intake port, the intake port having a substantially conical shape to increase flow efficiency of the intake air through the intake passageway; and an exhaust passageway defined in the engine housing upstream from the exhaust opening, the exhaust passageway including an exhaust runner upstream of the exhaust opening and an exhaust port upstream of the exhaust runner such that an exhaust valve is positioned in the exhaust port, the exhaust runner having a substantially conical shape to increase flow efficiency of exhaust gases through the exhaust passageway.

2. The air flow arrangement of claim 1, wherein the intake opening is substantially circular.

3. The air flow arrangement of claim 1, wherein the inlet crossover passageway draws intake air from a location adjacent a third side of the engine, the third side being opposite the second side.

4. The air flow arrangement of claim 1, wherein the substantially conical shape of the intake port defines an included angle between opposed side surfaces of the intake port of about 8 degrees to about 15 degrees.

5. The air flow arrangement of claim 1, wherein the substantially conical shape of the exhaust runner defines an included angle between opposed side surfaces of the exhaust runner of about 4 degrees to about 10 degrees.

6. The air flow arrangement of claim 1, further comprising an intake valve seat insert adapted for sealing contact with a head of the intake valve, wherein the intake valve seat insert has a peripheral edge and a radial thickness, and wherein the radial thickness of the intake valve seat insert is sized between about 1.8 mm and about 2.2 mm to improve heat transfer therethrough and decrease distortion of the intake valve seat insert.

7. The air flow arrangement of claim 6, further comprising a seal in sliding contact with a stem of the intake valve during reciprocal movement thereof, wherein the seal substantially prevents engine lubricant from contacting the head of the intake valve.

8. The air flow arrangement of claim 1, further comprising an exhaust valve seat insert adapted for sealing contact with a head of the exhaust valve, wherein the exhaust valve seat insert has a peripheral edge and a radial thickness, wherein the radial thickness of the exhaust valve seat insert is sized between about 1.8 mm and about 2.2 mm to improve heat transfer therethrough and decrease distortion of the exhaust valve seat insert.

9. The air flow arrangement of claim 8, wherein the exhaust runner is spaced from the exhaust valve seat insert between about 6 mm to about 12 mm to remotely position the exhaust runner from the exhaust valve seat insert to decrease temperature and distortion of the exhaust valve seat insert.

10. The air flow arrangement of claim 8, further comprising a valve guide adapted to support the exhaust valve during reciprocal movement thereof, such that the head of the exhaust valve undergoes intermittent sealing contact with the exhaust valve seat insert, wherein the valve guide is positioned in a reinforced portion of the engine to stabilize the valve guide.

11. The air flow arrangement of claim 1, further comprising:

an intake valve seat insert having a peripheral edge and adapted for sealing contact with a head of the intake valve; and an exhaust valve seat insert having a peripheral edge and adapted for sealing contact with a head of the exhaust valve, wherein the respective peripheral edges of the intake valve seat insert and the exhaust valve seat insert are spaced from each other between about 2.5 mm and about 5 mm to decrease heat transfer between the exhaust valve seat insert and the intake valve seat insert.

12. The air flow arrangement of claim 11, wherein an axial thickness of the intake valve seat insert is equal to about twice a radial thickness of the intake valve seat insert, and wherein an axial thickness of the exhaust valve seat insert is equal to about twice a radial thickness of the exhaust valve seat insert.

13. The air flow arrangement of claim 1, wherein the inlet crossover passageway defines a substantially constant cross-sectional area along a length of the inlet crossover passageway to increase flow efficiency of the intake air through the inlet crossover passageway.

* * * * *